US005173072A

United States Patent [19]

Ozawa

[11] Patent Number: 5,173,072

[45] Date of Patent: Dec. 22, 1992

[54] TRAVELLING TOY VEHICLE WITH SIMULATED STARTUP VIBRATION

[75] Inventor: Akio Ozawa, Tokyo, Japan

[73] Assignee: Tomy Company, Ltd., Japan

[21] Appl. No.: 745,670

[22] Filed: Aug. 16, 1991

[30] Foreign Application Priority Data

Aug. 23, 1990 [JP] Japan ..... 2-88150[U]

[51] Int. Cl.[5] ..... A63H 29/02; A63H 29/24; A63H 17/26; A63H 17/06

[52] U.S. Cl. ..... 446/462; 446/461; 446/466; 446/428

[58] Field of Search ..... 446/462, 461, 463, 466, 446/470, 459, 437, 420, 418, 499, 396, 484, 297, 428

[56] References Cited

U.S. PATENT DOCUMENTS

| | | | |
|---|---|---|---|
| 1,331,948 | 2/1920 | Wecht | 446/409 X |
| 2,146,665 | 2/1939 | Wood | 446/409 |
| 3,076,650 | 2/1963 | Richter | 446/409 X |
| 3,187,462 | 11/1965 | Licitis | 446/439 X |
| 3,738,701 | 6/1973 | Holloway | 446/428 X |
| 4,135,328 | 1/1979 | Yamasaki | 446/463 |
| 4,363,185 | 12/1982 | Masubuchi | 446/462 |
| 4,429,888 | 2/1984 | Wu | 446/428 X |
| 4,536,169 | 8/1985 | Fekete et al. | 446/461 |
| 4,547,174 | 10/1985 | Lee et al. | 446/463 |
| 4,585,423 | 4/1986 | Kwan | 446/437 X |
| 4,976,650 | 12/1990 | Watanabe | 446/418 |
| 5,074,820 | 12/1991 | Nakayama | 446/297 X |

FOREIGN PATENT DOCUMENTS

| | | | |
|---|---|---|---|
| 89017 | 3/1967 | France . | |
| 950038 | 2/1964 | United Kingdom . | |
| 1319927 | 6/1973 | United Kingdom . | |
| 2018144 A | 10/1979 | United Kingdom . | |
| 2018144 | 10/1979 | United Kingdom . | |
| 2097686 | 11/1982 | United Kingdom | 446/457 |
| 2226505 | 4/1990 | United Kingdom | 446/457 |

OTHER PUBLICATIONS

Search Report, UK Patent Office, Oct. 18, 1991.

*Primary Examiner*—D. Neal Muir
*Attorney, Agent, or Firm*—Staas & Halsey

[57] ABSTRACT

A travelling toy vehicle is provided having an external body in the shape of a dump truck or other vehicle. An internal gear box, or frame, drives two wheels on an axle. The frame contains a vibrating mechanism and rocks left and right by the motion of a spur gear disposed between two cylindrical force receiving pieces attached to the external body of the travelling toy vehicle. A power transmission route change mechanism couples driver power from a motor to the vibrating mechanism for a predetermined period of time to simulate ideling of the vehicle. Thereafter, the drive power is coupled to the travelling mechanism to provide forward movement of the travelling toy vehicle. Electrical power to the motor is switched on and off by pressing down against the rear portion of the travelling toy vehicle. An operation restricting lever mounted at the rear of the vehicle prevents the switching on of electrical power when the toy is being stored and allows manual use of the toy without propulsion by the motor.

10 Claims, 5 Drawing Sheets

TRAVELLING TOY VEHICLE WITH SIMULATED STARTUP VIBRATION

BACKGROUND OF THE INVENTION

1. Technical Field

The present invention relates to a travelling toy which is started after vibration of a toy body.

2. Description of the Related Art

Some travelling toys of prior art use a motor or a spring as a power source by which the toy is driven to travel straightforwardly or zigzag, wherein the amusingness of a travelling manner itself is pursued. These travelling toys, being immediately started by switch operation, lack the characteristic of actual cars that move after a warm-up operation during a specific period of time after starting.

SUMMARY OF THE INVENTION

An object of the present invention is to solve the above-mentioned problem.

Another object of the present invention is to provide a travelling toy vehicle that makes vibration when stationary and begins to move after the vibration stops like an actual car with the engine idling before moving.

The travelling toy according to the present invention has been developed to attain the aforesaid and other objects. This travelling toy which is run and stopped by switch operation comprises a power source which produces a drive power. A power transmission mechanism including a travelling mechanism runs the travelling toy by driving wheels mounted to the travelling toy with a power from the power transmission mechanism. A vibrating mechanism vibrates the travelling toy to right and left by the power from the power transmission. A power transmission route change mechanism changes, shortly after starting, a power transmission route for transmitting the power from the power transmission mechanism to the travelling mechanism side and changes the power transmission route back to the vibrating mechanism side in interlock with switch operation at the time of stopping.

The travelling toy having the vibrating and travelling mechanism and the power transmission route change mechanism is driven to vibrate for a specific period of time when stationary before moving, and stops vibration after the specific period of time, then moving like an actual car which makes an engine idling operation before moving. Also it is possible to add vibratory operation to the travelling toy which is travelling.

The above-mentioned and other objects and features of the present invention will become apparent from the following description when read in conjunction with the accompanying drawings.

BRIEF DESCRIPTION OF THE DRAWINGS

FIG. 4(*b*) is a side view of the changeover mechanism;

DETAILED DESCRIPTION OF THE PREFERRED EMBODIMENTS

Figure 1:
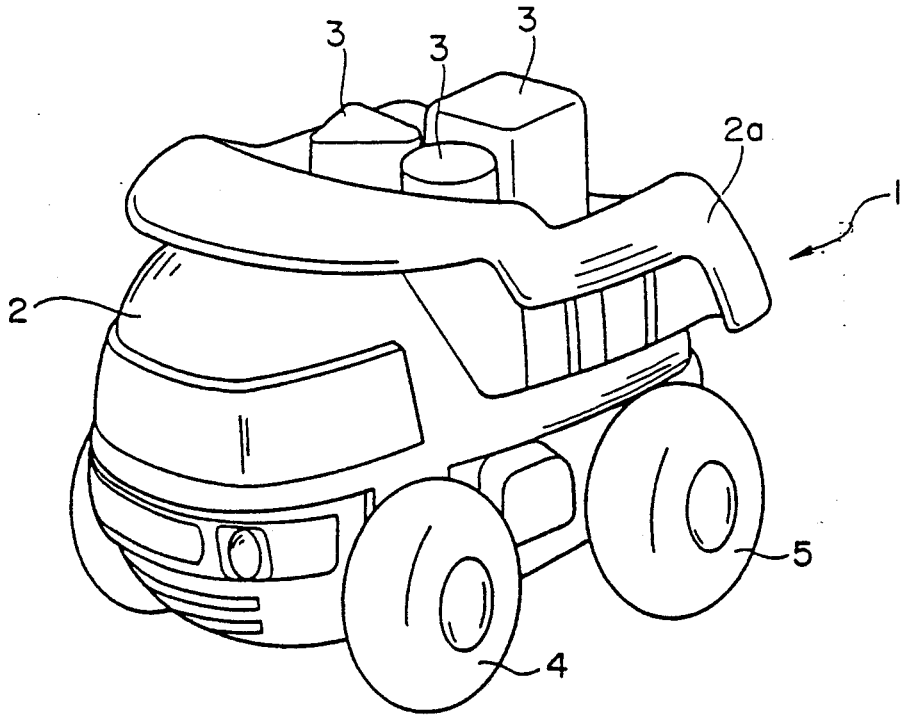
FIG. 1 is a perspective view of a travelling toy according to the present invention.

FIG. 1 is a perspective view showing the travelling toy of the present invention. This travelling toy 1 is a toy having an external appearance like a dump truck equipped with front and rear wheels 4 and 5. At the rear of the body 2 a rear body 2*a* is pivotably mounted. The rear body 2*a* can be loaded with building block 3 and raised on a shaft 6 (FIG. 2) serving as a body pivot pin. The travelling toy 1 is designed as to operate as follows. When the rear body 2*a* is pushed down from above, its body 2 vibrates for a specific period of time. After this period of vibration the toy 1 stops vibrating and starts to travel forwardly, and stops when the rear body 2 is pushed again from above during travel.

Figure 2:
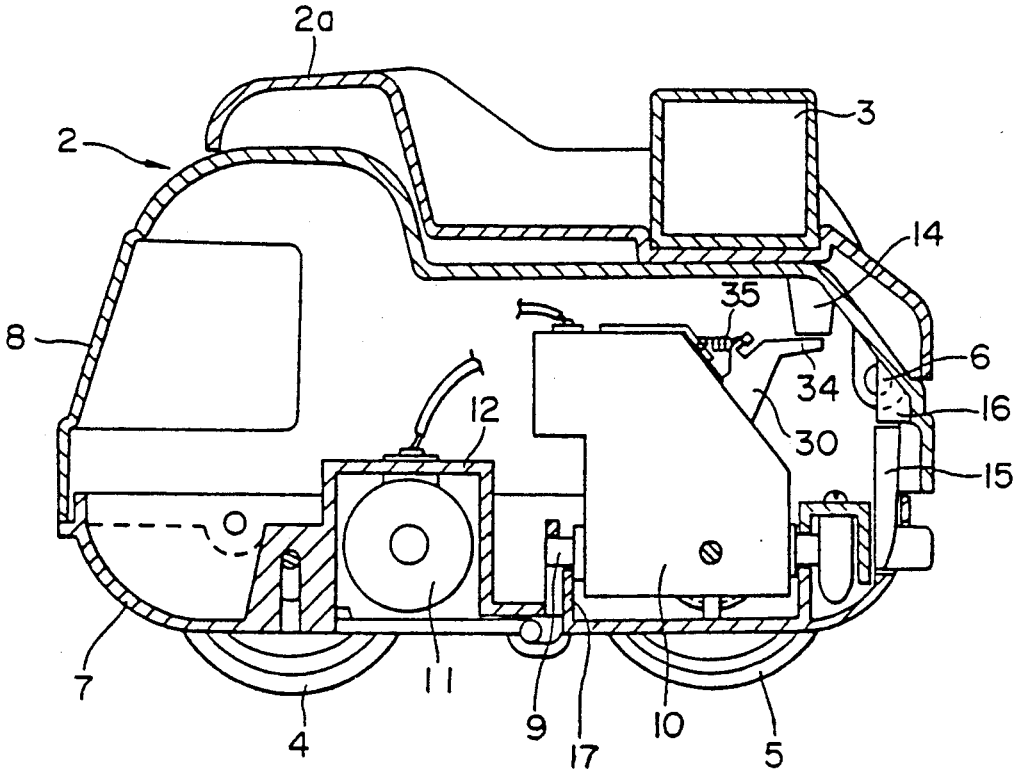
FIG. 2 is a longitudinal sectional view of the travelling toy according to the present invention.
Figure 3:
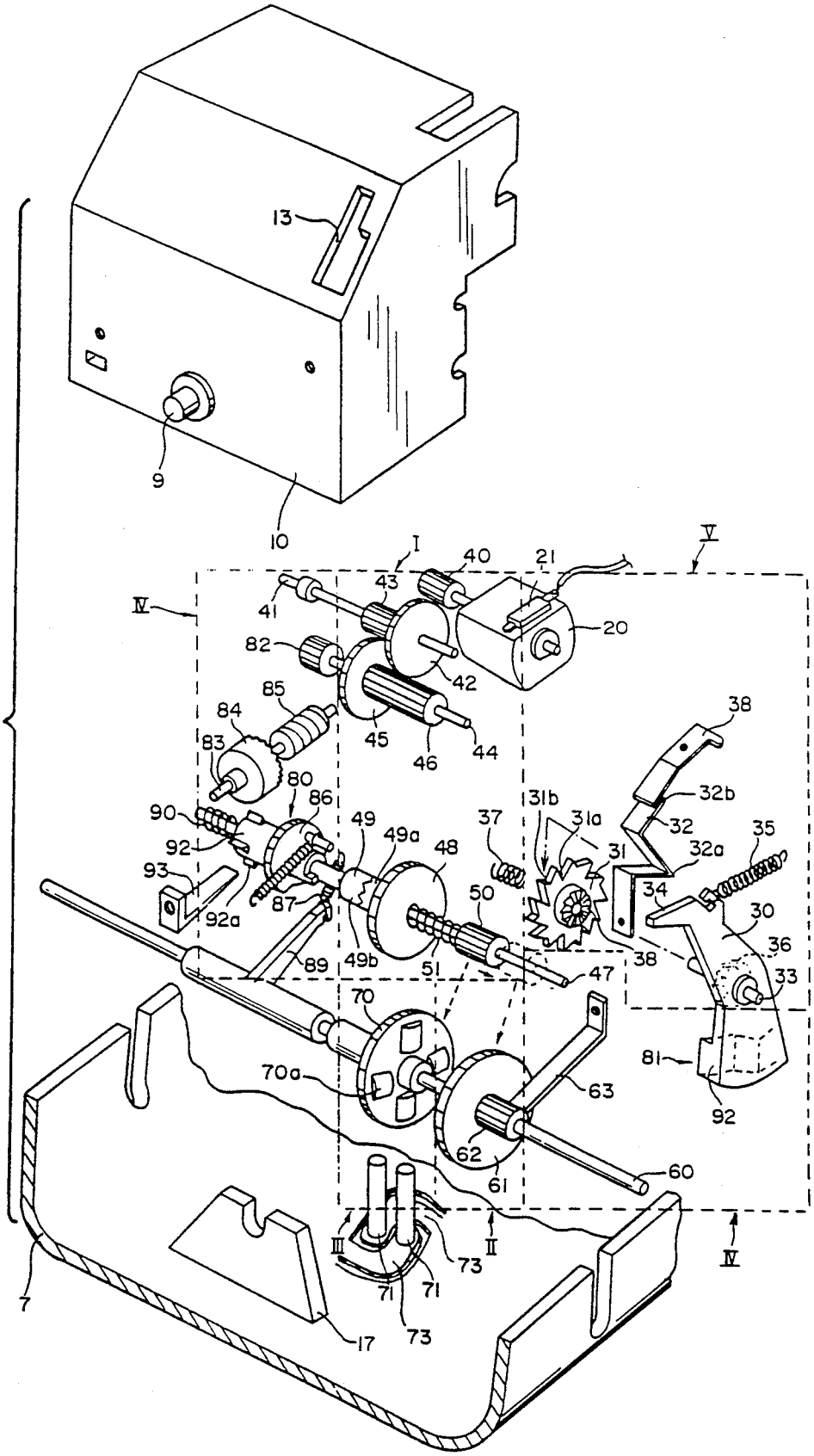
FIG. 3 is a perspective view of a changeover mechanism which constitutes a power transmission route change mechanism.

The body 2, as shown in FIG. 2, consists of a lower case 7 and an upper case 8. In the body 2, a frame 10 (or gearbox) is mounted which houses various kinds of mechanisms. A motor 20 is housed in the frame 10 as a power source to produce drive power. The frame 10 is capable of making a relative motion with respect to the body 2 on the support point where the shaft 9 is supported on a bearing 1.7. The housing 12 also contains a battery 11.

Hereinafter, the various kinds of mechanisms housed in the frame 10 will be explained. A power transmission mechanism is housed in the frame 10 to the power produced by the motor 20. A travelling mechanism II is also housed in the frame 10 to drive the travelling toy by the power from the motor 20 through the power transmission mechanism I. A vibrating mechanism III to vibrate the body 2 with the power coming through the power transmission mechanism I, a power transmission route change mechanism IV to change the route of transmission of the power from the power transmission mechanism I, and a switch mechanism V to operate and stop the travelling toy are also housed in the frame 10.

The switch mechanism V is used to turn on and off the motor 20 by pressing down on the rear body 2*a* (the rear of body 2) having a switch operating section. This switch mechanism V includes a switch lever 30 which turns in interlock with the pressing of the rear body 2*a*, a ratchet wheel 31 which, receiving the rotating force from the switch lever 30, turns intermittently every time the switch lever 30 is operated, and a contact tongue 32 which comes in electrical contact with, and is released from, an electrode of the motor 20.

The switch lever 30 is rotatably supported on a shaft 33 which is mounted on the frame 10. One end of this switch lever 30 projects out of an opening 13 of the frame 10 and has a contact section 34 which contacts a switch-actuating projection 14 mounted under the rear body 2*a*. To the switch lever 30 the return force of a return spring 35 is applied in the reverse direction of pressing.

On the shaft 33, a ratchet gear 36 is mounted which rotates as one body with the switch lever 30. Furthermore, the rachet wheel 31 is on the shaft 33 mounted which can turn idle. On the side of this ratchet wheel 31 another ratchet gear 38 is integrally formed which is engaged with the ratchet gear 36 with the pressure of the spring 37. Then, the ratchet wheel 31 turns intermittently in the same direction by the rotational force of the switch lever 30. Teeth of the ratchet wheel 31 are generated to form one pitch with a switch-off section 31*a* having a deep tooth surface plus a switch-on section 31*b* having a shallow tooth surface. Ratchet wheel 31 is designed to turn by a half pitch per rotation of the switch lever 30.

The contact tongue 32 is a nearly V-shaped member produced of an elastic material. The contact tongue 32 is secured at one end of the frame 10; the other end is a movable end which operates into, and out of, an electrical contact with a contact tongue 38 connected with an electrode 21 of the motor 20. When the V-shaped root 32*a* is in mesh with the switch-on section 31*b* of the ratchet wheel 31, the other end 32*b* of the contact tongue 32 comes into electrical contact with the contact tongue 38. When the V-shaped root 32*a* is in mesh with the switch-off section 31*a* of the ratchet wheel 31, the other end 32*b* of the contact tongue 32 is released form the contact tongue 38. The operation of these contact tongues 32 and 38 turns on and off the motor 20.

The power transmission mechanism I is designed to transmit the rotational force of a drive gear 40 of the motor 20 to the travelling mechanism II and the vibrating mechanism III through a spur gear 42 and a pinion 43 mounted on a shaft 41, a spur gear 45 and a long gear 46 mounted on a shaft 44., and a spur gear 48, a clutch 49 and a pinion 50 mounted on a shaft 47. The spur gear 48 can idle and move axially with respect to the shaft 47.

The clutch comprises one clutch jaw 49*a*, integrally formed with the spur gear 48, and another clutch jaw 49*b* fixedly mounted on the shaft 47. The clutch jaws 49*a* and 49*b* are always kept in mesh with each other by the action of a spring 51.

The travelling mechanism II is secured on an axle 60 supporting rear wheels 5, and includes a spur gear 61 which can mesh with the final pinion 50 of the power transmission mechanism I. The rear wheels 5 are driven to rotate by the power from the power transmission mechanism I, thereby forwardly moving the toy 1.

The vibrating mechanism III is mounted, capable of idling, on the axle 60, and includes a spur gear 70 which can engage with the final pinion 50 of the power transmission mechanism I, thereby vibrating the body 2 to the right and left by the power from the power transmission mechanism I. On both sides of the spur gear 70 four semi-cylindrical cams 70*a* are disposed in staggered positions. Two cylindrical vibrating force receiving pieces 71, 71 are installed upright in the lower case 7 as if sandwiching the spur gear 70 from both sides. When the spur gear 70 is rotated by the power from the power transmission mechanism I, the cams 70*a* provided on both sides alternately rub the inner side of each of the vibrating force receiving pieces 71 to push them to the right and left, thus laterally vibrating the lower case 7 and the body 2 on the center of the shaft 9. The two cylindrical vibrating force receiving pieces 71, 71 can be attached directly to the lower case 7 or connected through springs 73 formed in the lower case 7.

The power transmission route change mechanism IV comprises a changeover mechanism 80 for switching the power transmission route from the vibrating mechanism III side to the travelling mechanism II side, and a return mechanism 81 for switching the power transmission route back to the vibrating mechanism III side in interlock with switch operation to stop the forward motion of the toy. The changeover mechanism 80 is of such a design that as a pinion 82 fixedly mounted on the shaft 44 rotates in one body with the long gear 46, a sector gear 86 freely rotatably mounted on the shaft 47 is turned by the rotational force of the pinion 82 for a specific period of time through a crown gear 84 and a worm gear 85. Both the crown gear 84 and the worm gear 85 are secured on a shaft 83 intersecting at right angles with the shaft 44. Then, an unlocking projection 88*a* releases a locking lever 89. The locking lever 89 is rotatably supported on the shaft 60 and, in normal operation, held in engagement with the slide surface 88 formed on one side of the sector gear 86 by the action of the spring 87. The locking lever 89 moves the shaft 47 in the axial direction thereof by the force of the spring 90 to move the pinion 50 secured on the shaft 47 and in engagement with the spur gear 70 side, into mesh with the spur gear 61 side.

Figure 4A:
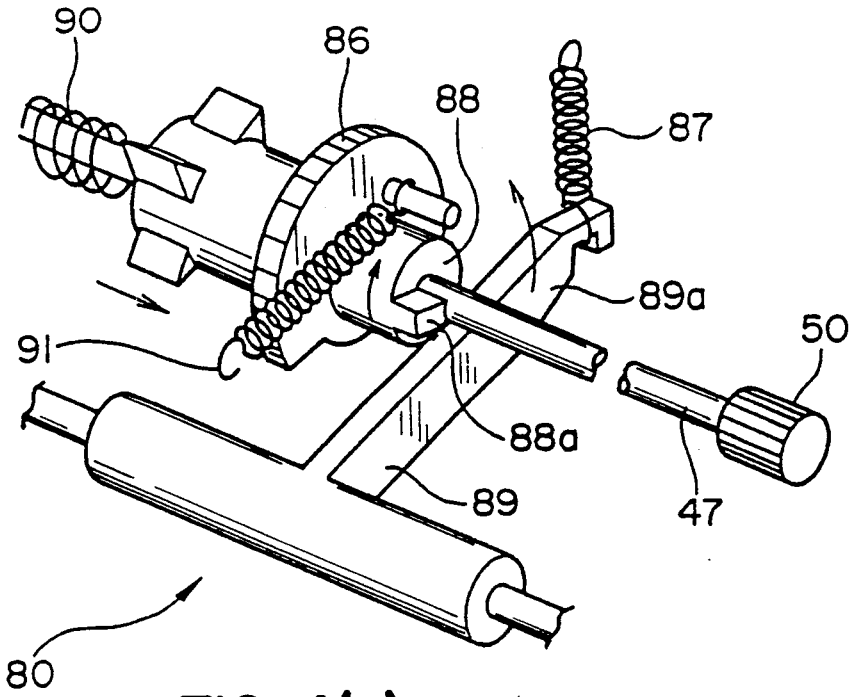
FIG. 4(*a*) is a perspective view of a changeover mechanism.
Figure 4B:
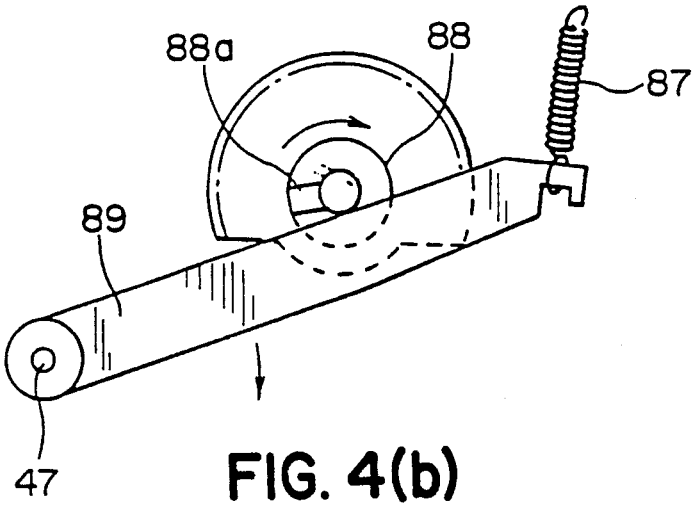
Figure 5:
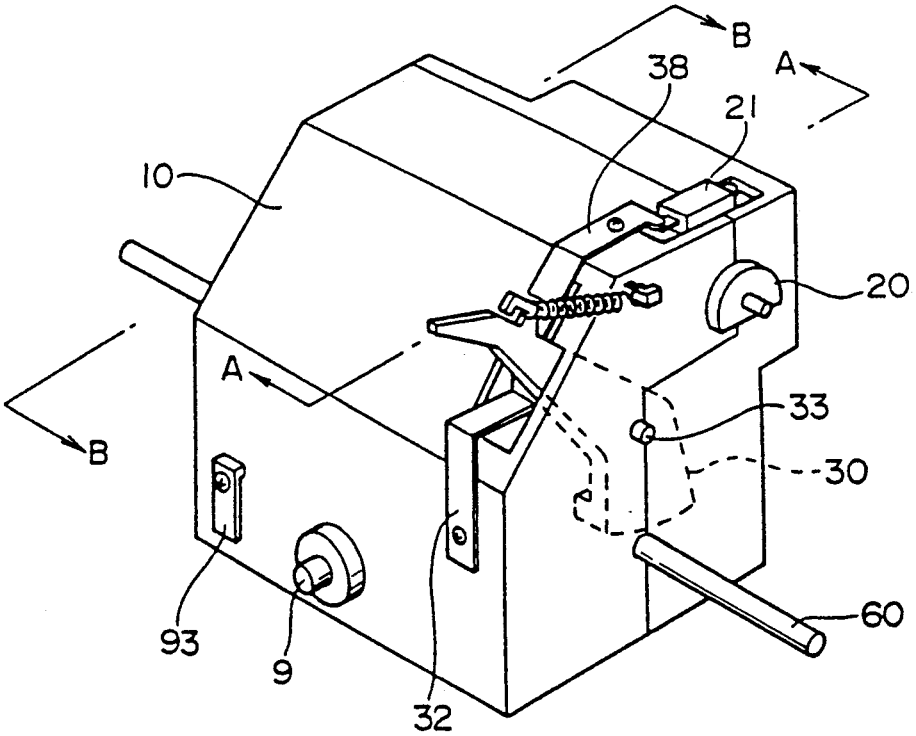
FIG. 5 is a perspective view of a frame containing various mechanisms of the travelling toy 1.
Figure 6:
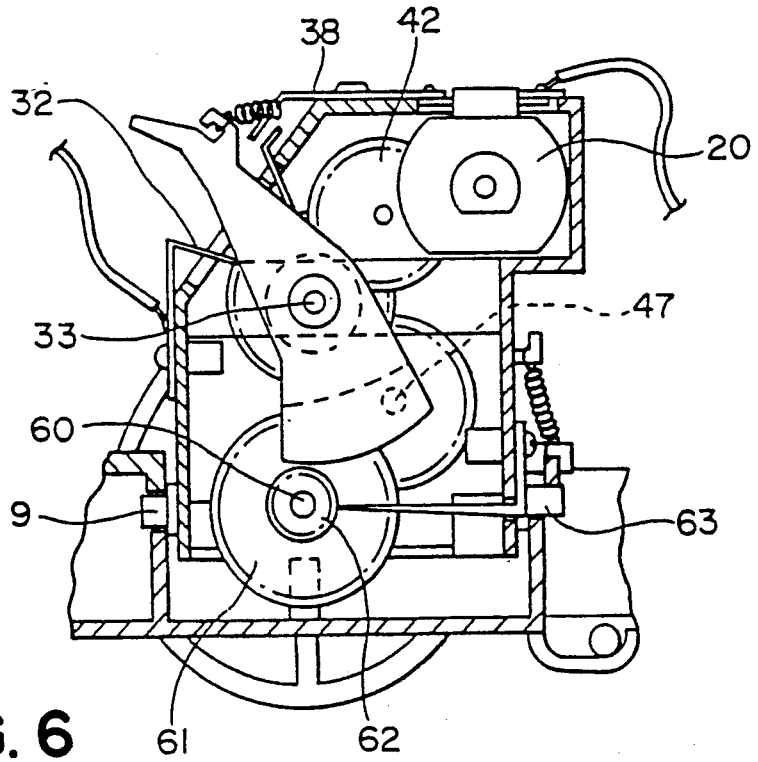
FIG. 6 is a sectional view of the frame taken along line A—A in FIG. 5.
Figure 7:
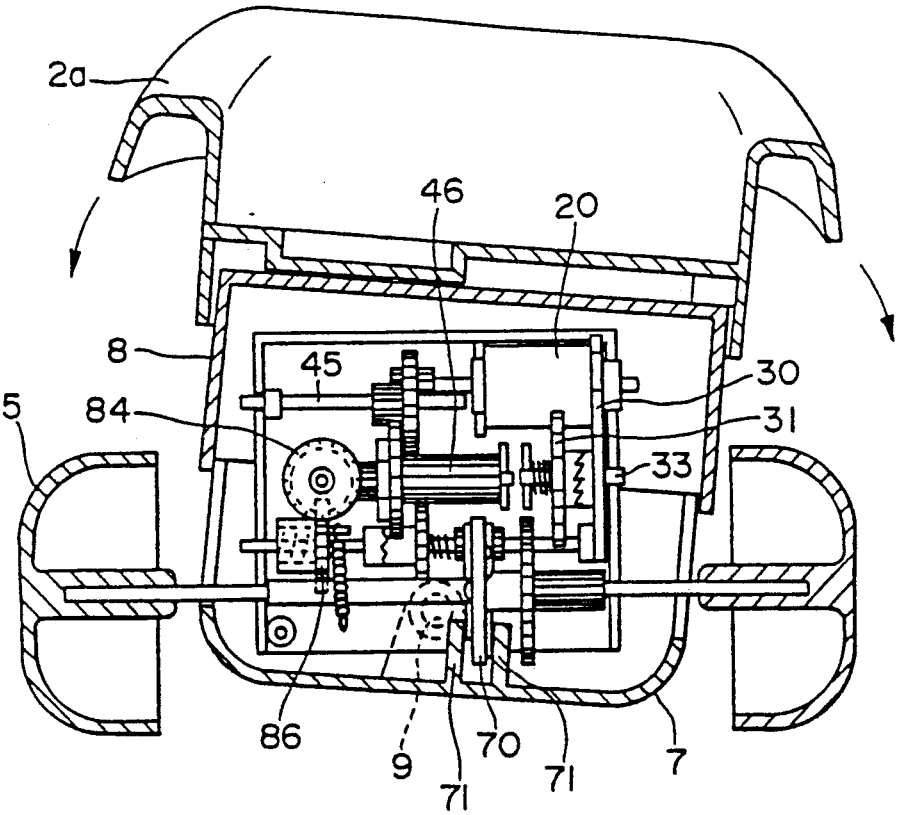
FIG. 7 is a sectional view of the frame taken along line B—B in FIG. 5.
Figure 8:
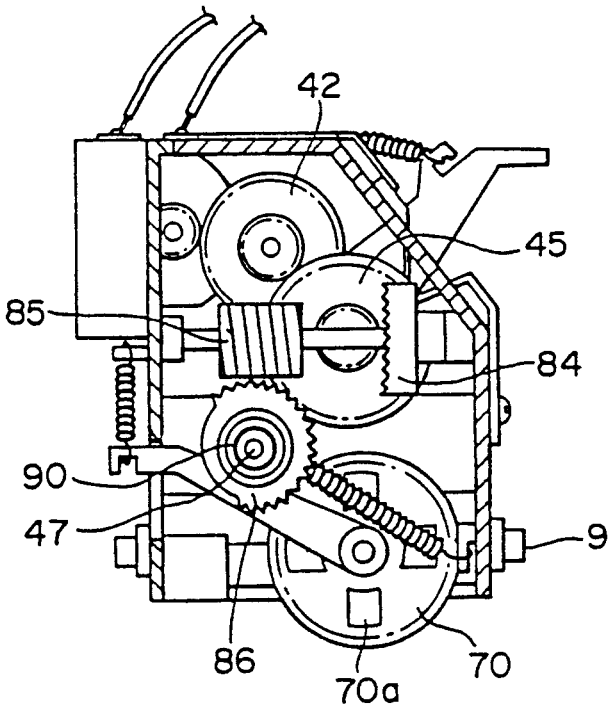
FIG. 8 is a cross sectional view of the travelling toy.

Hereinafter, the relation of the locking lever 89 and the sector gear 86 will be particularly described with reference to FIGS. 4(*a*) and 4(*b*). When the sector gear 86 makes a half turn from the initial state shown in FIGS. 4(*a*) and 4(*b*), the unlocking projection 88*a* comes into contact with the upper part of an arm section 89*a* of the locking lever 89. Furthermore, as the sector gear 86 rotates, the locking lever 89 is pushed downwardly by the unlocking projection 88*a* against the force of the spring 87. Then, the unlocking projection 88*a*, when having reached the lower position, snaps off the locking lever 89, which therefore comes off the sliding surface 88 and at the same time the shaft 47 is moved to the right in FIG. 4(*a*) by the force of the spring 90. Also, in this case, the sector gear 86 comes out of engagement with the worm gear 85, being turned back to the initial position by the return spring 91. Additionally, the distance of axial movement of the shaft 47 is restricted by the contact of its forward end with the side surface of the switch lever 30.

The return mechanism 81 comprises a cam 92 formed on the side surface of the switch lever 30. The cam 92 moves the shaft 47, which is in the travelling position in which the pinion 50 is in mesh with the spur gear 61, back to the vibrating position side with the rotation of the switch lever 30. With this return operation, the shaft 47 moves as far as the vibrating position, in which the worm gear 85 and the sector gear 86 come into mesh with each other, and at the same time the pinion 50 comes into mesh with the spur gear 70. At the same time, the locking lever 89 comes into engagement with the sliding surface 88 of the side surface of the sector gear 86.

Inside the rear end of the upper case 8, a switch operation restricting lever 15 is installed to mechanically prevent the switch mechanism V from being activated when the rear body 2*a* (rear or body 2) is pushed down. When the switch operation restricting lever 15 is properly set with its top end in contact with a switch operation restricting lever contact section 16, it is possible to play with the toy using one's hands to move the vehicle. Furthermore, if the toy is carelessly put into a toy box, the switch operation restricting lever 15 will prevent the switch lever 30 from electrically activating the motor 20 and running down the battery 11.

A sound producing gear 92, securely mounted on the side of the sector gear 86, has sound-producing pieces 92*a* arranged intermittently. With the rotation of the sector gear 86, the sound-producing gear 92 produces a sound every time each of them touches a sound-producing tongue 93. Various patterns of sound producing pieces 92*a* can be placed on the sound producing gear 92 to produce a particular idling or other forward running sound for the vehicle. The length of the sound-producing tongue 93 and the material it is mounted on can be chosen for a desired pitch and depth of sound. Furthermore, on the side of the spur gear 61 is fixedly attached a sound-producing gear 62, which, in contact with a sound-producing tongue 63,/ produces a sound with the rotation of the spur gear 61. The length or mounting material of the sound-producing tongue 63 can likewise be varied.

The travelling toy according to the present embodiment can be played with as follows. For example, when the rear body 2*a* of the travelling toy 1 which is stopped, is pushed downwardly, the switch lever 30 rotates to turn on the motor 20. The drive power from the motor 20 is transmitted to the vibrating mechanism III through the power transmission mechanism I, thereby vibrating the body 2. At the same time, the power from the motor 20 is transmitted to the power transmission route change mechanism III to turn the sector gear 86. With the rotation of the sector gear 86, the locking lever 89 comes off the unlocking projection 88*a*, thus releasing the sector gear 86. Accordingly, the shaft 47 moves to the travelling position, changing the power transmission route from the vibrating mechanism III side to the travelling mechanism II side. Consequently, the body 2 stops vibrating, while the power coming through the power transmission mechanism I is transmitted to the travelling mechanism II to turn the rear wheels 5, thus moving the travelling toy forwardly.

When the rear body 2*a* of the travelling body 1 thus running is pushed downwardly, the switch lever 30 turns to stop the motor 20, and accordingly the travelling toy 1 stops advancing. At the same time, as the switch lever 30 rotates, the return mechanism 81 operates to move the shaft 47 from the travelling position back to the vibrating position. In this state, the power from the power transmission mechanism I is transmitted to the vibrating mechanism III and to the power transmission route change mechanism IV. Thus, the toy body becomes ready for vibrating when the rear body 2*a* is pushed downwardly again.

According to the travelling toy of the present embodiment described above, the body 2 vibrates to the right and left prior to travelling as if an actual dump truck vibrates during engine warm-up operation. It is, therefore, possible to produce a travelling toy capable of being used just like an actual motor vehicle. Further, it is possible to make a more amusing travelling toy by adding the vibrating mechanism to a conventional travelling toy which otherwise can do nothing but travelling. Furthermore, because the rear body 2*a* which forms the body of the travelling toy includes a switch operating section, the toy itself has much the same appearance of an actual vehicle motor. It is, therefore, possible to produce travelling toys which work like an actual motor vehicle.

The travelling toy according to the present embodiment has the appearance of a dump truck with a rear body 2*a* but may be any other kind of travelling toy such as a fire truck, a locomotive, an airplane, and a boat. For example, the fire truck can have an extendably raisable ladder pivotably mounted on a rear upper surface. Furthermore, the vibrating mechanism according to the present embodiment described above is designed to vibrate to the right and left, but may be so designed as to make up-and-down vibration. Also, in the travelling toy according to the present embodiment, a motor is adopted as a power source, but a spring may be used in place of the motor. Additionally, according to the present embodiment, the travelling toy is equipped with a mechanical power transmission route change mechanism, but the change of the power transmission route may be electronically controlled by means of an integrated circuit. Furthermore, the number of the cams 70*a* on the spur gear 70 according to the present embodiment is not necessarily limited to four on either side, but may be one or more.

According to the present invention, because of the adoption of the vibrating and travelling mechanisms and the power transmission route change mechanism, it is possible to provide a new, amusing travelling toy which vibrates before moving just like an actual motor vehicle with its engine idling before moving. Thus, the travelling toy excites amusement by adding vibration motion.

While the invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

What is claimed is:

1. A travelling toy vehicle having an external body and at least one drive wheel, comprising:

a motor to provide drive power;

a travelling mechanism rotatingly coupled to the at least one drive wheel;

a vibrating mechanism vibratingly cooperating with the external body and comprising a spur gear drivably connected to said motor and including a plurality of semi-cylindrical cams on each side of said spur gear and cylindrical force receiving pieces connected to the external body and cooperating with said semi-cylindrical cams on each side of said spur gear; and a power transmission route change mechanism operatively coupled to said motor and selectively coupling the drive power from said motor to either one of said travelling mechanism and said vibrating mechanism.

2. A travelling toy vehicle according to claim 1, wherein said power transmission route change mechanism comprises:

a selector gear having an unlocking projection;

a locking lever cooperatingly disposed against said unlooking projection; and an axially movable shaft slidingly coupled to either one of said travelling mechanism and said vibrating mechanism in accordance with a position of said locking lever.

3. A travelling toy vehicle having an external body and at least one drive wheel, comprising:

a motor to provide drive power;

a travelling mechanism rotatingly coupled to the at least one drive wheel;

a vibrating mechanism vibratingly cooperating with the external body; and a power transmission route change mechanism operatively coupled to said motor and selectively coupling the drive power from said motor to either one of said travelling mechanism and said vibrating mechanism, said power transmission route change mechanism couples the drive power to said vibrating mechanism for a predetermined period before coupling the drive power to said travelling mechanism, said power transmission route change mechanism comprising a selector gear drivably connected to said motor and having an unlocking projection, a locking lever cooperatingly disposed against said unlocking projection of said selector gear and an axially movable shaft slidingly coupled to either one of said travelling mechanism and said vibrating mechanism in accordance with a position of said locking lever.

4. A travelling toy vehicle having an external body and at least one drive wheel, comprising:

a motor to provide drive power;

a travelling mechanism rotatingly coupled to the at least one drive wheel;

a vibrating mechanism operatively connected to impose at least a vibrating motion between the external body and the at least one drive wheel; and a power transmission route change mechanism operatively coupled to said motor and selectively coupling the drive power from said motor to either one but not both of said travelling mechanism and said vibrating mechanism, said power transmission route change mechanism couples the drive power to said vibrating mechanism and not to said traveling mechanism upon powerup for a predetermined period and, after the predetermined period, uncouples the drive power from said vibrating mechanism and couples the drive power to said traveling mechanism.

5. A travelling toy vehicle according to claim 4, wherein said vibrating mechanism vibratingly cooperates with the external body.

6. A travelling toy vehicle according to claim 5, further comprising an internal frame, housing at least said vibrating mechanism and rockingly coupled to the external body by at least two joints.

7. A travelling toy vehicle according to claim 4, further comprising an internal frame, housing at least said vibrating mechanism and rockingly coupled to the external body by at least two joints.

8. A travelling toy vehicle according to claim 4, further comprising:

a switch mechanism disposed against the external body of the travelling toy vehicle and selectively providing electrical power to said motor.

9. A travelling toy vehicle according to claim 8, wherein said travelling toy vehicle further comprises a hinge coupled to said external body at a first end; and wherein said switch is disposed against said external body at a second end opposite the first end.

10. A travelling toy vehicle according to claim 9, further comprising:

an operation restricting lever mounted at the second end and disposed against the external body to selectively prevent pivoting of said hinge.

* * * * *